US011731735B2

(12) United States Patent
Percy et al.

(10) Patent No.: US 11,731,735 B2
(45) Date of Patent: Aug. 22, 2023

(54) AUTONOMOUSLY CONTROLLED HYDROFOIL SYSTEM

(71) Applicant: Artemis Technologies Limited, Slough (GB)

(72) Inventors: Iain Percy, Slough (GB); Romain Ingouf, Slough (GB)

(73) Assignee: ARTEMIS TECHNOLOGIES LIMITED, Slough (GB)

( * ) Notice: Subject to any disclaimer, the term of this patent is extended or adjusted under 35 U.S.C. 154(b) by 0 days.

(21) Appl. No.: 17/056,804

(22) PCT Filed: Nov. 12, 2020

(86) PCT No.: PCT/GB2020/052883
§ 371 (c)(1),
(2) Date: Nov. 19, 2020

(87) PCT Pub. No.: WO2021/094760
PCT Pub. Date: May 20, 2021

(65) Prior Publication Data

US 2022/0266949 A1 Aug. 25, 2022

(30) Foreign Application Priority Data

Nov. 14, 2019 (GB) ..... 1916548
Nov. 12, 2020 (GB) ..... 2017845

(51) Int. Cl.
*B63B 1/28* (2006.01)
*B63B 79/40* (2020.01)
(Continued)

(52) U.S. Cl.
CPC ..... *B63B 1/286* (2013.01); *B63B 1/246* (2013.01); *B63B 79/10* (2020.01); *B63B 79/40* (2020.01); *B63H 21/21* (2013.01)

(58) Field of Classification Search
CPC ..... B63B 1/286; B63B 1/246; B63B 79/40; B63B 79/10; B63H 21/21
See application file for complete search history.

(56) References Cited

U.S. PATENT DOCUMENTS 3,504,649 A 4/1970 Scherer
3,886,884 A 6/1975 Stark et al.
3,958,522 A * 5/1976 Harang ..... B63B 1/286 244/175

FOREIGN PATENT DOCUMENTS

EP 3453605 3/2019
EP 3453605 A1 3/2019
(Continued)

OTHER PUBLICATIONS

Combined Search and Examination Report under Sections 17 & 18(3) in Application GB2017845.5 dated Apr. 29, 2021.
(Continued)

*Primary Examiner* — Stephen P Avila
(74) *Attorney, Agent, or Firm* — Thomas Horstemeyer, LLP

(57) ABSTRACT

The present invention relates to a hydrofoil system for a waterborne vessel, the hydrofoil system comprising a controller, a foil for engagement with the waterborne vessel, the foil comprising a plurality of adjustment members operable to vary the lift characteristics of the waterborne vessel, a propeller, an engine and gearbox located adjacent the foil and operable/in mechanical communication with the propeller, a plurality of sensors in electrical communication with the controller, each sensor configured to monitor flight parameters of the waterborne vessel and generate measured flight parameter data, wherein the controller is in communication with the adjustment members, the engine and the sensors and wherein the controller is configured to receive measured flight parameter data from the sensors and to
(Continued)

control the operation of the engine and the position of the adjustment members in dependence upon the received measured flight parameter data.

14 Claims, 7 Drawing Sheets

(51) Int. Cl.

| | |
|---|---|
| ***B63B 79/10*** | (2020.01) |
| ***B63B 1/24*** | (2020.01) |
| ***B63H 21/21*** | (2006.01) |

(56) References Cited

FOREIGN PATENT DOCUMENTS

| | | | |
|---|---|---|---|
| GB | 2591562 | | 4/2021 |
| JP | H0350090 | A | 3/1991 |
| JP | H0350090 | | 4/1991 |
| JP | H05178268 | A | 7/1993 |
| JP | H05178268 | A | 7/1993 |
| WO | 2018/229356 | | 12/2018 |
| WO | WO-2018/229356 | A1 | 12/2018 |

OTHER PUBLICATIONS

Patents Act 1977: Search Report under Section 17 in Application GB2017845.5 dated Apr. 28, 2021.
"Examination and Search Report"; prepared for GB1916548.9; dated Apr. 16, 2020; 2 pages.

* cited by examiner

AUTONOMOUSLY CONTROLLED HYDROFOIL SYSTEM

Application PCT/GB2020/052883 claims priority from Application GB 2017845.5 filed on Nov. 12, 2020 in the United Kingdom. Application PCT/GB2020/052883 claims priority from Application GB 1916548.9 filed on Nov. 14, 2019 in the United Kingdom. The entire contents of these applications are incorporated herein by reference in their entirety.

The present invention relates to an autonomously controlled, electrically powered hydrofoil system for use with yachts, sailboats and ships. In particular, the present invention relates to such a hydrofoil system incorporating a high power-density electrical engine.

BACKGROUND OF THE INVENTION

A sailing hydrofoil is a wing-like structure mounted under the hull of a boat, such as a yacht, that provides a speed advantage over more traditional boat designs. The sailing hydrofoil works with its wing-like appendage. Just like a wing on an aircraft provides lift, a hydrofoil in the water accomplishes the same thing. The main difference is that a hydrofoil does not need to be as large as an airplane wing, because the water is much denser than air. As the boat increases its speed the hydrofoils lifts most of the hull, or even the entire hull, up and out of the water, greatly reducing the wetted area, resulting in decreased drag and increased speed as the craft cuts through the water.

Most types of boats can accommodate hydrofoils, and sailboats are no different. A sailing hydrofoil could be a single hull, often referred to as a mono hull, a catamaran (which has two hulls), or a trimaran (which has three hulls). In the case of multiple hulls, the hulls are held together by a single upper deck. The wider and longer the ship, the more stable the sailing hydrofoil is.

Conventional hydrofoils are used in either a passive way i.e. there is no active control on their geometry or in an active way i.e. using flaps to cause the craft to ascend or descend and to control the craft about its pitch, heave and roll axes. However, all control is manual e.g. using a control system with a mechanical lever arm, and the flaps require human intervention, which inherently requires extensive experience by a user and exposes the craft control to human error. In the same way as for aircraft, there is an inherent trade-off between a requirement for faster and more accurate control and overall drag (a lower drag foil will come at the cost of inherent stability).

There is therefore a need for an improved method of active control of a hydrofoil which avoids human error and results in a large reduction in overall draft and fuel/energy usage.

SUMMARY OF THE INVENTION

The present invention seeks to address the problems of the prior art. Aspects of the present invention are set out in the attached claims.

A first aspect of the present invention provides a hydrofoil system for a waterborne vessel, the hydrofoil system comprising a controller; a foil for engagement with the waterborne vessel, the foil comprising a plurality of adjustment members operable to vary the lift characteristics of the waterborne vessel; a propeller; an engine and gearbox located adjacent the foil and operable/in mechanical communication with the propeller; and a plurality of sensors in electrical communication with the controller, each sensor configured to monitor flight parameters of the waterborne vessel and generate measured flight parameter data, wherein the controller is in communication with the adjustment members, the engine and the sensors and wherein the controller is configured to receive measured flight parameter data from the sensors and to control the operation of the engine and the position of the adjustment members in dependence upon the received measured flight parameter data.

In one embodiment, the hydrofoil system may further comprise a battery system in electrical communication with the controller and the engine and operable by the controller to provide power to the engine.

Preferably, each of the adjustment members is operable to vary one or more of pitch, roll, heave, and yaw of the waterborne vessel.

In one embodiment, the engine comprises a high-power density electrical engine, referred to as a Motor Generator Unit (MGU).

In one embodiment, each adjustment member comprises a flap and an actuator, wherein the flap is moveable relative to the foil on activation of the actuator by the controller. Preferably, the adjustment member is housed within a hydrodynamic fairing Preferably, the actuators are integrated within the foil. However, it is to be appreciated that the actuators may alternatively be integrated inside the vessel, depending on the respective sizes of the foil and vessel.

In one embodiment, each of the plurality of flaps is independently adjustable. This provides greater control over the position of the vessel within the water.

In a further embodiment, the plurality of flaps comprises at least one set of two aligned flaps. However, additional flaps may be provided within each set of flaps if required.

In one embodiment, the foil defines an elongate channel therethrough, the channel having a first open end and a second end opposing the first open end, and wherein the first open end and second end are in fluid communication with one another.

Preferably, the propeller is located at the second end of the elongate channel. Thus, the first end of the elongate channel is located in the direction of travel of the vessel, whilst the propeller is located distal to the first end. Fluid may therefore flow through the channel from the first end to the second end. Preferably, the engine is located within the elongate channel between the first open end and the propeller and more preferably between the foil shaft and elevator. Thus, fluid flow through the channel will provide cooling for the engine and gearbox located within the channel.

In one embodiment, the foil is provided with a plurality of fluid inlets such that the elongate channel is in fluid communication with the exterior of the foil. The inlets may comprise slots or gills. However, any other suitable shape of inlet known to the skilled person may be used in addition to, or as an alternative to, slots or gills.

Preferably, the fluid inlets are located radially around the foil adjacent one of both of the engine and gearbox. The fluid inlets may be regularly spaced along the length of the elongate channel or may be more concentrated in specific areas of the elongate channel e.g. towards the first end to encourage the flow of cooled fluid past the engine.

In an alternative embodiment, the foil comprises a watertight gearbox casing within which the engine and gearbox are located, wherein both the engine and gearbox are a close fit within the gearbox casing.

The close fit allows the engine and gearbox to be in thermal contact with the gearbox casing such that heat generated by the engine and/or gearbox during use may be transferred by contact to the gearbox casing, which is subsequently cooled by the surrounding water in which it is submerged. No mechanical or forced water flow is required to cool the engine and gearbox.

Preferably, the engine is located adjacent the gearbox. The engine may comprise an MGU and the gearbox may include epicyclic reduction hardware, both being located within the watertight gearbox casing. The gearbox casing forms part of the foil and locates the engine to the foil structure.

The gearbox casing is thermally conductive in order to cool the engine and gearbox by heat transfer into the surrounding environmental water. Preferably, the gearbox casing comprises metal, and preferably coated or non-corrosive/corrosive resistant raw metal. However, it is to be appreciated that any suitable known to the skilled person and highly resistant to corrosion could be used as an alternative to, or in addition to, using metal for the gearbox casing.

The propeller is located adjacent to the gearbox via a short propeller shaft, in order to minimise efficiency loss.

As with conventional foils, each foil of the present invention is composed of two lifting surfaces: the elevator (horizontal part) which provides vertical lift; and a shaft, whose main purpose is to carry the elevator and also provide side force in turns and manoeuvres.

The measured flight parameter data may comprise any one or more selected from the group comprising acceleration data, vessel position data (pitch, heave, yaw, roll), actuator positional data, external environmental factors (e.g. wind, wave-height) and any other useful data relating to the movement of the vessel through the water, and the environment the vessel is moving in.

Preferably, the controller is located within the hull of the waterborne vessel and the foil is located beneath the floating waterline on the hull exterior of the waterborne vessel.

In a further embodiment, the hydrofoil system further comprises a battery system in electrical communication with the foil and operable to provide power to the engine and adjustment member. Alternatively, the adjustment member may be actuated using hydraulic power. Such a battery system may comprise a Power Electronics Control Unit (PECU).

A second aspect of the present invention provides a waterborne vessel including a hydrofoil system according to a first aspect of the present invention. It is to be appreciated that the hydrofoil system according to the first aspect of the present invention may be provided integrally as part of a new vessel during manufacture, or may be provided for retrofit to an existing vessel. In both cases, the vessels will then have all the advantages provided by the hydrofoil system. Such advantages include:

- the reduced hydrodynamic drag provides increased autonomy (for a given amount of battery power)
- human-free optimised control of the vessel during travel, thereby avoiding human errors;
- controlled positioning of the vessel within the water e.g. ride height via adjustment of the flaps in response to real-time measured flight parameter data;
- no mechanical engine cooling system is required as water-flow around the engine and gearbox occurs during travel of the vessel through the water;
- No fossil fuel usage is required during travel of the vessel and all power is provided in a carefully controlled manner from the battery system in dependence upon the needs of the vessel to optimise the ride;
- Increased ride comfort for passengers as the position of the vessel within the water is carefully controlled and the optimised ride height reduces the amount of hull exposed to the water conditions; and
- Vessel wash significantly reduced.

Thus, the hydrofoil system of the present invention provides a high efficiency and low consumption propulsion system for high speed marine travel whilst providing autonomous control of a fully submerged actively controlled foiling waterborne vessel.

DETAILED DESCRIPTION OF THE PREFERRED EMBODIMENTS

Figure 1:
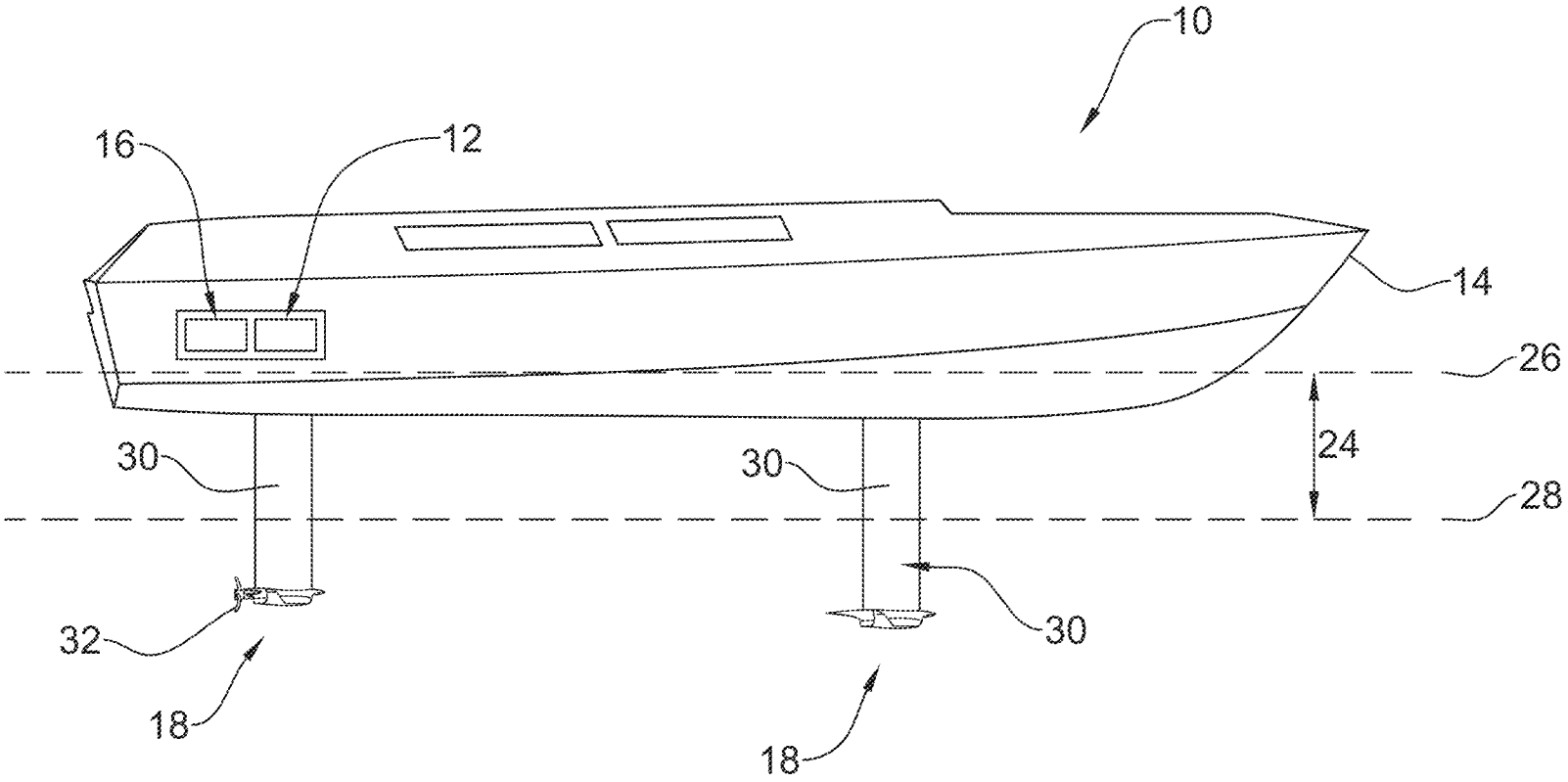
FIG. 1 shows an embodiment of the hydrofoil system in accordance with a first aspect of the present invention integrated into a mono-hull vessel.

FIG. 1 shows a waterborne vessel in the form of a monohulled vessel 10 provided with an embodiment of a hydrofoil system in accordance with a first embodiment of the present invention. The hydrofoil system comprises a controller 12 located within the hull 14 of vessel 10.

A battery system 16 is located adjacent controller 10, and in electrical communication with controller 10. In the embodiment of FIG. 1, battery system 16 comprises a Power Electronics Control Unit (PECU).

A foil 18 is located on the outer surface of the foil hull below the floating waterline. Foil 18 comprises a plurality of adjustment members 19 operable to vary the lift characteristics of the vessel 10 during travel. Each adjustment member comprises a flap 20 and associated actuator 22. Actuators 22 can be either electric or hydraulic and may be integrated within foil 18 (as shown in FIG. 1) or may be located within the vessel 10 itself depending on the vessel size and associated foil size. Actuators 22 operate to control the position of associated flaps 20 to control the ship in heave i.e. ride height 24 relative to the floating water line 26), pitch, roll and thrust. Ride height 24 is shown in FIG. 1 and is based on the distance between the water surface (floating water line 26) and the foiling water line 28. Foiling water line refers to where the water free surface sits, relative to the foils/hull, while airborne. When the boat is floating, the water line is defined by how much the hull needs to sink to obtain the volume of displacement (under Archimedean hydrostatic force). When foiling, the foiling water line is the optimum between minimum foil immersion (the vertical part "shaft") to reduce drag without having the elevator 52 ventilating because of the free surface proximity.

Figure 2:
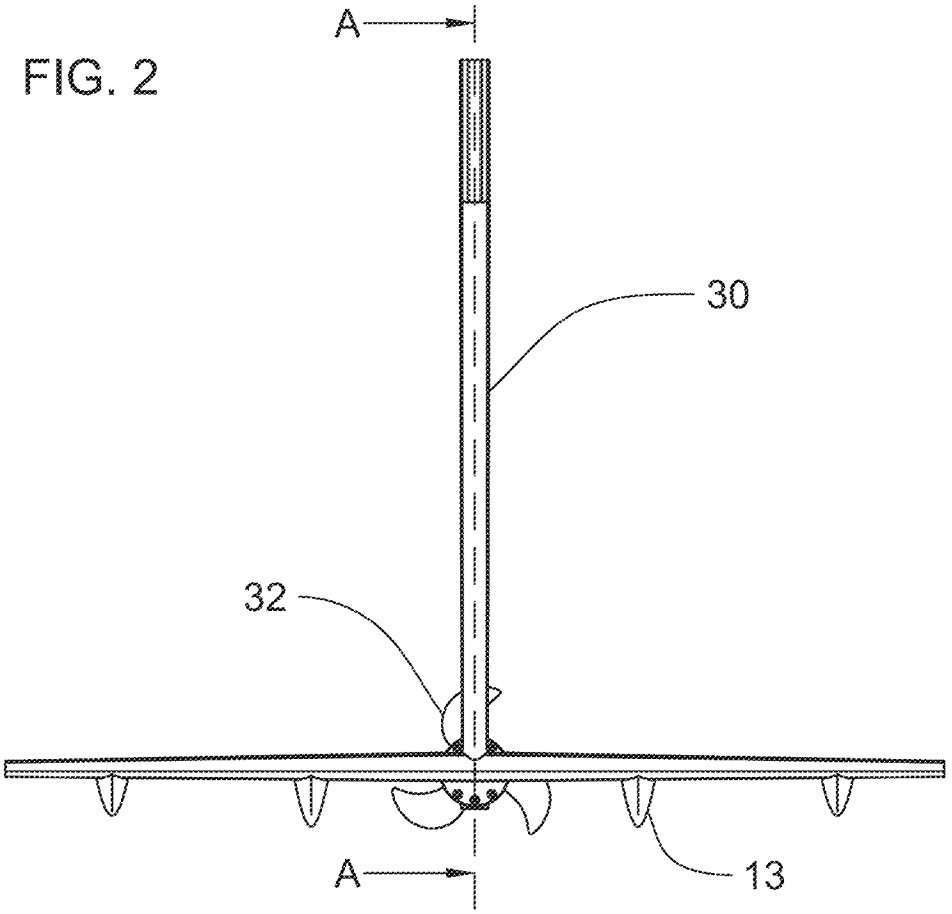
FIG. 2 is a front view of a foil and propeller of the hydrofoil system of FIG. 1.
Figure 5:
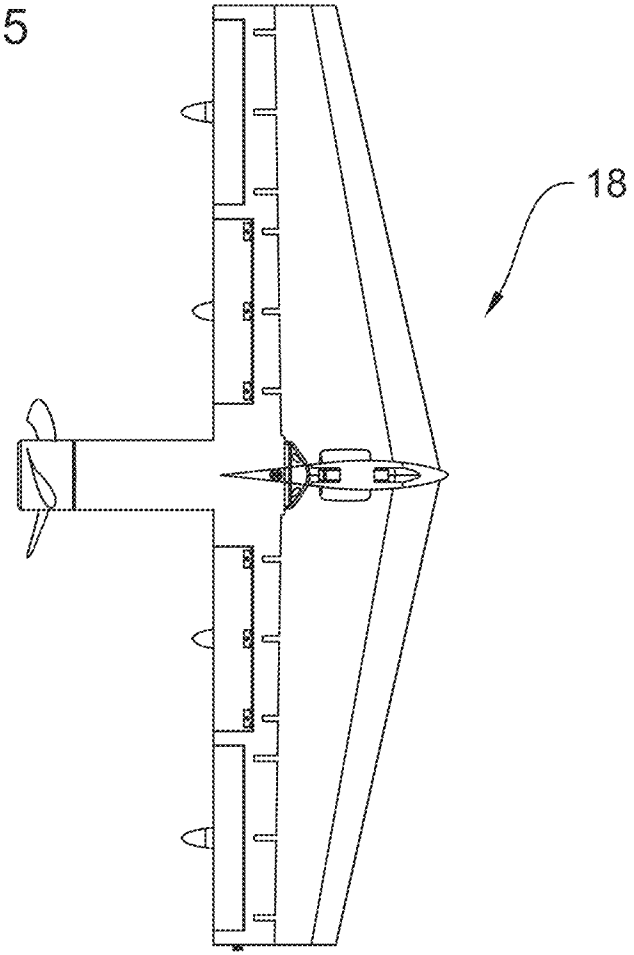
FIG. 5 is a view from above of the foil and propeller of FIG. 2.
Figure 4:
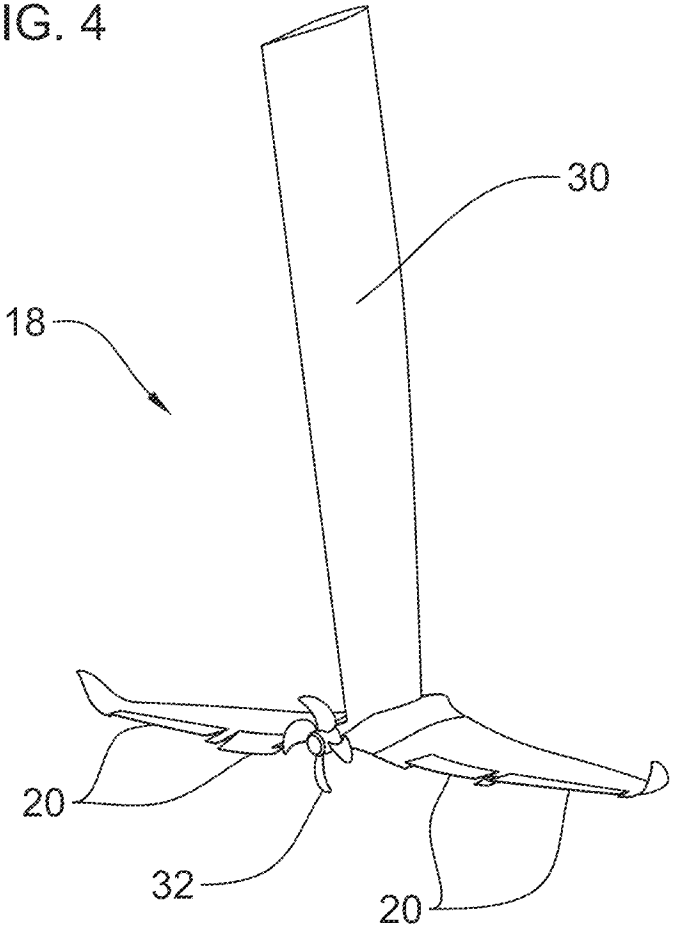
FIG. 4 is a perspective view of the foil and propeller of FIG. 2.

In the embodiment of FIG. 2, the adjustment member 13 further comprises a hydrodynamic fairing 21 within which the flap 20 is arranged.

In FIGS. 2 to 5, each foil comprises four flaps 20, each flap 20 is independently operable by an associated actuator 22.

Foil 18 is connected to the hull 14 of vessel 10 by means of a vertical shaft 30.

A propeller 32 is mounted on foil 18 for driving the vessel 10 through the water during travel. The propeller 32 and foil 18 are shown in more detail in FIGS. 2 to 7.

Figure 6:
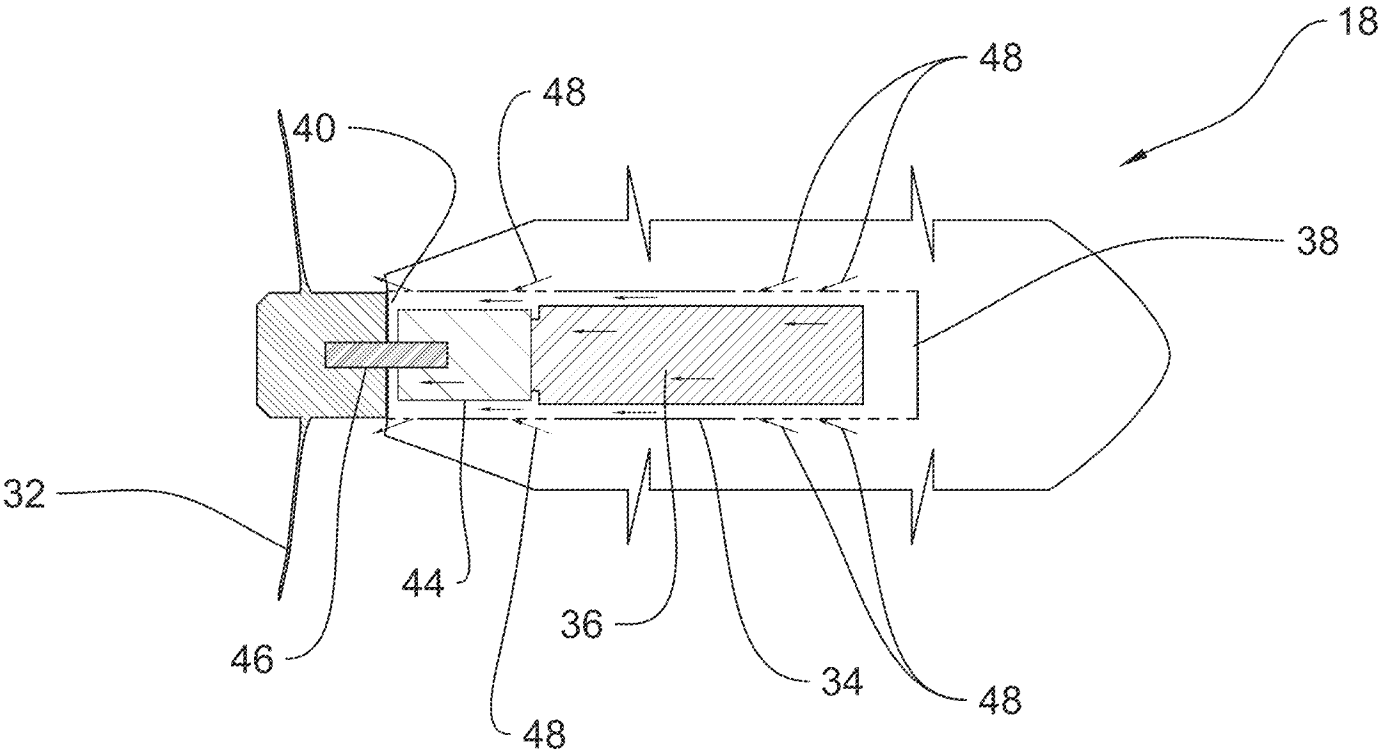
FIG. 6 is an X-Y cross-section through the foil and propeller of FIG. 2 showing a first example of a gearbox and engine arrangement with water flow cooling between the gearbox and engine arrangement and the interior surface of the foil body.
Figure 7:
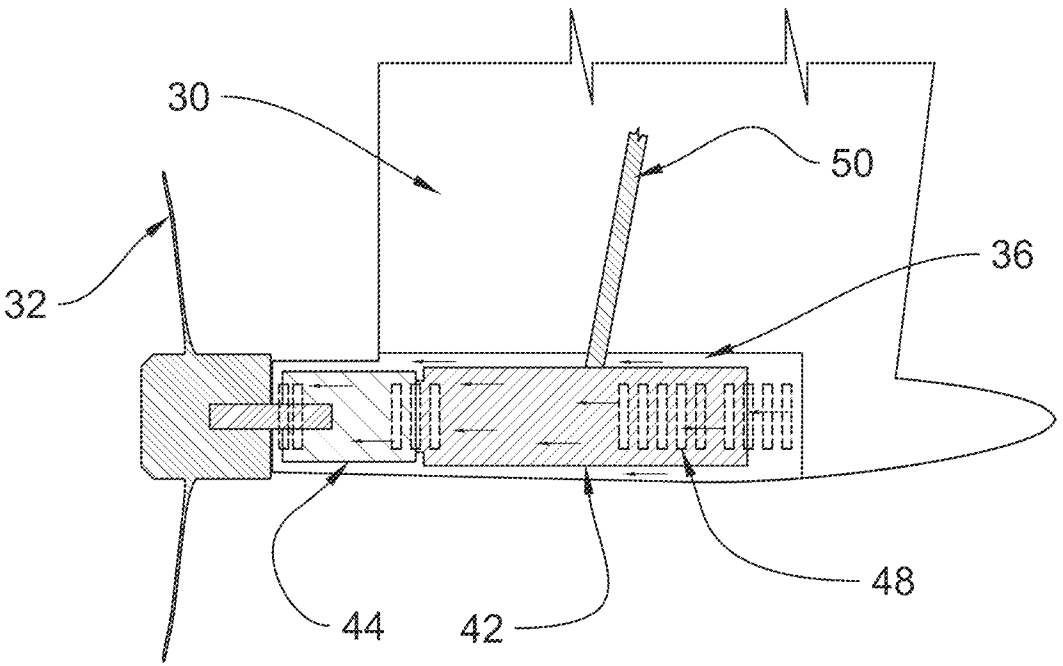
FIG. 7 is a Z-X cross-section through the foil and propeller of FIG. 2 showing the gearbox and engine arrangement of FIG. 6.

In a first embodiment shown in FIGS. 6 and 7, foil 18 comprises a body 34 defining an elongate channel 36. Elongate channel 36 has a first open end 38 and a second end 40 opposing the first end 38, first and second ends 38, 40 being in fluid communication with one another. Propeller 32 is mounted on the foil at the second end 40 of channel 36.

An engine 42 and aligned gearbox 44 are mounted within elongate channel 36 and mechanically coupled to propeller drive shaft 46. At a first end, electrical harness 50 is electrically coupled to engine 42. Engine 42 is an MGU.

At a second opposing end, engine 42 is electrically coupled to battery system 16 and controller 10 via electrical harness 50 that extends through vertical shaft 30, such that, in use, electrical harness 50 transfers energy from the battery system 16 to engine 42 which drives propeller drive shaft 46 via gearbox 44 to rotate propeller 32. The engine 42 acts as a generator, deploying energy from the battery system 16 to drive gearbox 44.

Electrical harness 50 is a flexible electrical connection, rather than a conventional mechanical linkage. The presence of a flexible electrical harness 50 extending vertically through foil 18, rather than a mechanical linkage, allows for more streamlined containment of the connection within the foil, thus permitting an improved foil profile with increased hydrodynamic efficiency.

Fluid inlets 42 are provided radially around body 34 such that channel 36 is in fluid communication with the exterior of foil 18 i.e. exterior water may flow through fluid inlets 42 into channel 44. Thus, when vessel 10 is travelling through the water, water flows through fluid inlets 42 into channel 36 and flows past engine 42 and gearbox 44 in a direction towards the second end 40 of channel 36. Further, water will be drawn in through open first end 38 of channel 36 and also flow past engine 42 and gearbox 44 towards second end 40. The flow of exterior water into channel 36 and around engine 42 and gearbox 44 serves to cool the engine and gearbox during use, preventing overheating and allowing operation of the engine and gearbox at higher speeds than possible in the absence of a cooling system.

In the figures, fluid inlets 48 are shown as slots or gills However, it is to be appreciated that any suitable shape of fluid inlet known to the skilled person and suitable for the circulation of water from the exterior of foil 18 into channel 36 and around engine 42 and gearbox 44 may be used in addition to, or as an alternative to, the slots or gills shown in FIGS. 6 and 7. Further, the number and location of fluid inlets 42 may be varied from that shown in the figures provided a sufficient volume of fluid flow past engine 42 and gearbox 44 is possible to provide the required cooling to be achieved during travel of vessel 10.

Figure 8:
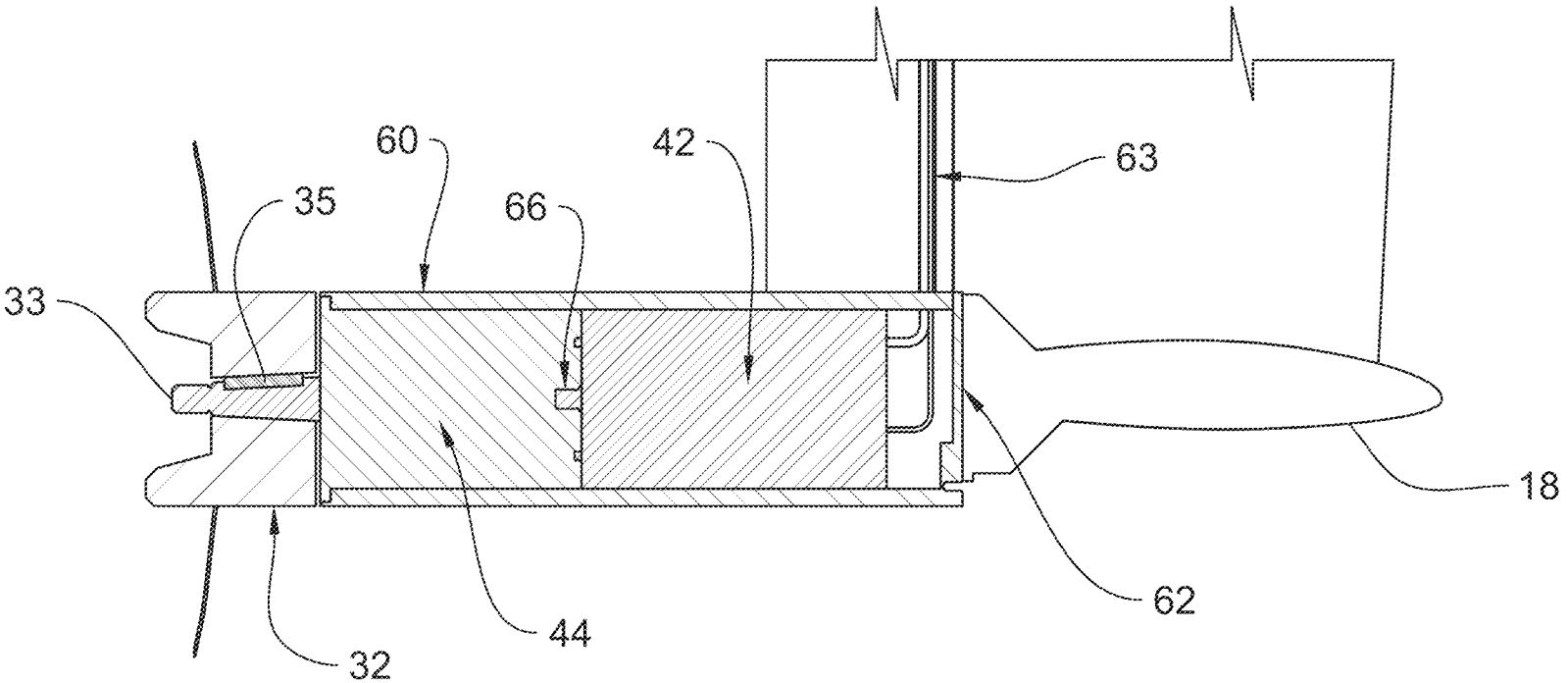
FIG. 8 is an X-Y cross-section through the foil and propeller of FIG. 2 showing a second example of a gearbox and engine arrangement with heat-transfer cooling via the gearbox casing.

In a second embodiment, shown in FIG. 8, foil 18 comprises a housing 60 defining a receiving space in which engine 42 and gearbox 44 are received. Housing 60 provides a watertight housing for engine 44. Engine 42 and gearbox 44 are located adjacent one another within housing 60 housing 60 and are connected via shaft 66 that transmits the torque and rotation from engine 42 to the gearbox 44. The outer surfaces of both engine 42 and gearbox 44 are located adjacent the interior surface of housing 60 such that heat generated during use is absorbed from engine 42 and gearbox 44 by housing 60 and subsequently dissipated into the surrounding water, thus providing an efficient cooling system that avoids the need for mechanical or forced flow of fluid past the engine 42 and/or gearbox 44 within housing 60.

Propeller 32 is connected to gearbox 44 distal to engine 42 and is engaged with gearbox 44 via propeller shaft 33. Propeller 32 connects to propeller shaft 33 by means of a conical arrangement with a key 35 in a conventional manner. Propeller shaft 33 enters the gearbox 44 through bearings and connects with the gearbox toothed wheels (not shown).

Propeller shaft 33 enters housing 60 through seals that maintain the water-tight integrity of housing 60.

At the opposing side of housing 60, housing 60 connects to foil 18 at interface 62. Housing 60 is bolted to a flange on the foil (not shown). Interface 62 is sealed and channels are provided for the electrical harnesses 63 of power train assembly 64 to exit the housing 60 and extend vertically along vertical shaft 30 of foil 18, to provide an electrical connection between the engine 42 and gearbox 42 and the controller located in the hull 14 of vessel 10.

Seals are provided at the point of exit of the electrical harnesses 64 from housing 60 to maintain the water-tight integrity of the housing 60.

In the embodiment shown in FIG. 8, gearbox 42 is an epicyclic gearbox and engine 44 is a motor generator unit (MGU). However, it is to be appreciated that this is just one embodiment and a skilled person may use an alternative gearbox and engine to achieve the same arrangement within gearbox housing 60.

Figure 3:
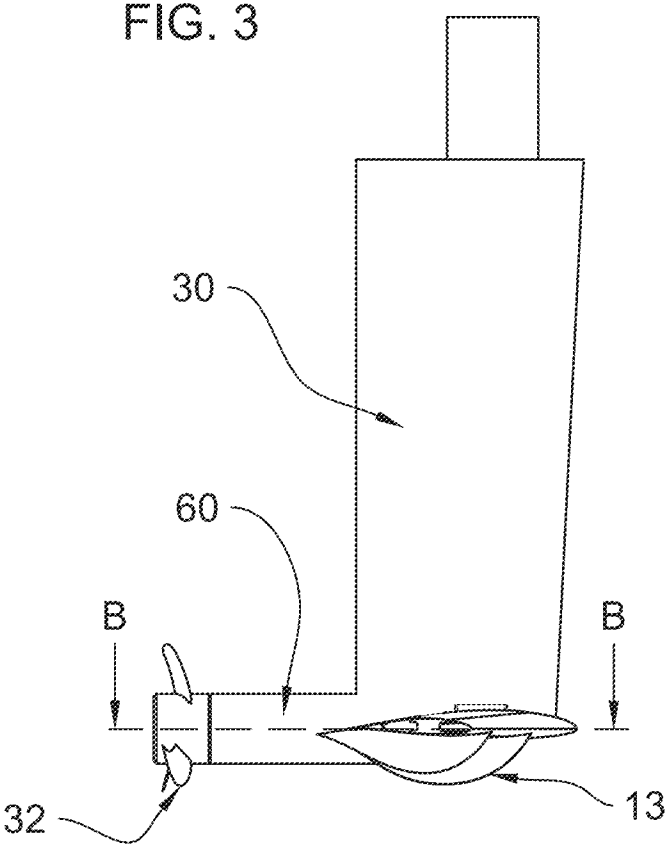
FIG. 3 is a side view of the foil and propeller of FIG. 2.

In the hydrofoil system of the present invention, the vessel 10 is further provided with a plurality of sensors (not shown) in electrical communication with controller 12, each sensor configured to monitor one or more flight parameters of vessel 10 and generate measured flight parameter data based on the monitored flight parameter. This measured flight parameter data is then provided to controller 10 which uses the measured flight parameter data to determine what adjustments are required to the engine and adjustment members 13 to optimise the vessel 10 travel through the water. Adjustment member 13 is shown in FIGS. 2 and 3 with its hydrodynamic fairing. Controller 10 then communicates engine 42 to control the operation of propeller 32. Controller 12 also communicates with actuators 22 to control the position of the adjustment members 13 in dependence upon the measured flight parameter data. This has the effect of influencing the speed of the vessel through the water and/or the position of vessel 10 within the water i.e. the heave, pitch, roll and/or thrust of vessel 10 within the water.

The sensors may provide measured flight parameter data to the controller on a continuous basis or on demand from the controller or in a predetermined programmed manner. Obviously, continuously provided data will produce continuous feedback from controller 12 to influence the operation of the engine and the position of the vessel 10 within the water, providing continuously optimised travel of the vessel 10 through the water.

The sensors may be located in multiple positions embedded in the hull and foils, and measure various flight parameters of vessel 10 including, but not limited to monitoring/measuring acceleration, position (pitch, heave, yaw, roll), ride-height data, actuator positional data, and any other useful parameter relating to the movement of the vessel through the water.

Figure 9A:
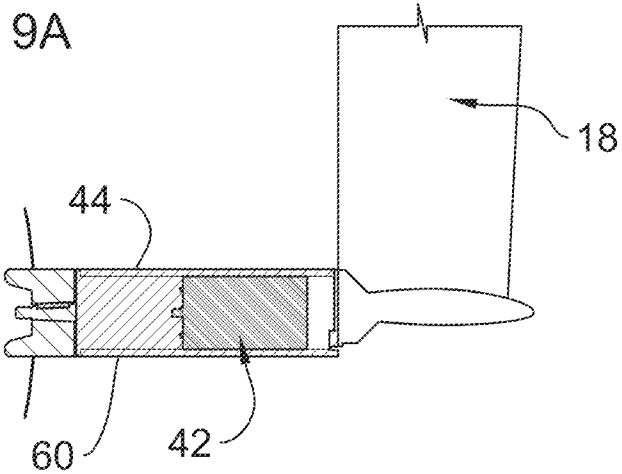
FIGS. 9A to 9D are cross-sectional views showing variants of the gearbox and engine arrangement of FIG. 8 where the housing is mounted on the foil.
Figure 9B:
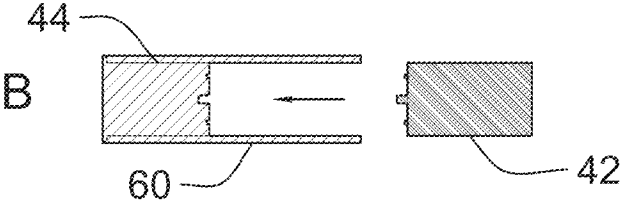
Figure 9C:
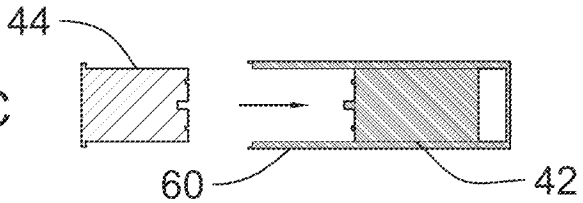
Figure 9D:
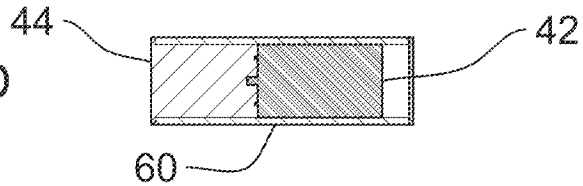

FIG. 9A shows the arrangement where the housing 60 is mounted on foil 18, whilst FIGS. 9B to 9D show variations on how this can be achieved.

FIG. 9B shows an arrangement wherein housing 60 is provided as part of the gearbox 42, and during assembly, engine 44 is slotted into gearbox housing 60, and housing 60 subsequently made water-tight in a conventional manner.

In FIG. 9C, housing 60 is provided as part of the engine 44 and, during assembly, gearbox 42 is slotted into engine housing 60, and housing 60 subsequently made water-tight in a convention manner.

FIG. 9D shows an arrangement wherein housing 60 is distinct from both engine 42 and gearbox 44. Engine 42 and gearbox 44 are slotted into housing 60 towards one another from opposing ends of housing 60. Alternatively, engine 42 and gearbox 44 may be sequentially slotted into housing 60 from the same end. Housing 60 is subsequently made water-tight in a conventional manner to contain both engine 42 and gearbox 44 therewithin.

Figure 10A:
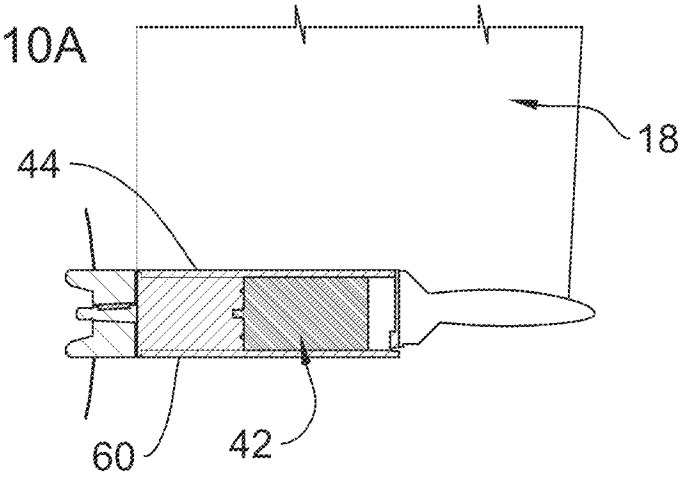
FIGS. 10A and 10B are cross-sectional views showing further variants of the gearbox and engine arrangement of FIG. 8 where the housing is provided by a portion of the foil.

FIG. 10A shows an arrangement where housing 60 is provided by a portion of foil 18. Engine 42 is slotted into housing 60, followed by gearbox 44 before housing 60 is made water-tight in a convention manner to retain both engine 42 and gearbox 44 within foil 18.

Figure 10B:
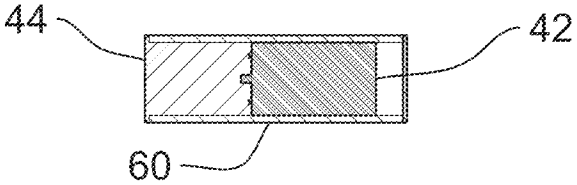

Alternatively, and as shown in FIG. 10B, housing 60 may be provided as a channel through foil 18. Engine 42 and gearbox 44 are slotted into housing 60 towards one another from opposing ends of housing 60. Housing 60 is subsequently made water-tight in a conventional manner to contain both engine 42 and gearbox 44 within foil 18.

Figure 11:
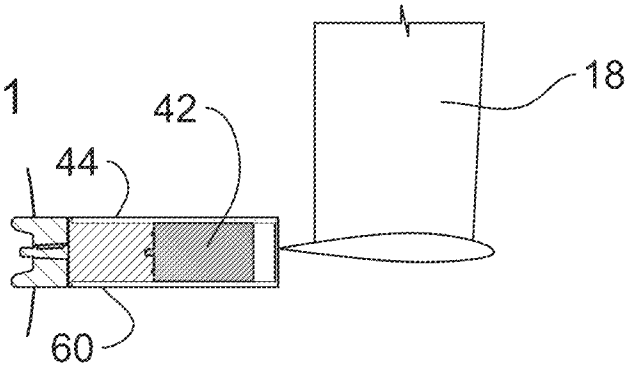
FIG. 11 is a cross-sectional view showing a further variant of the gearbox and engine arrangement where the housing is separate from the foil.

Finally, FIG. 11 shows an arrangement wherein housing 60 is spatially separated from foil 18. It is to be appreciated that the assembly of housing arrangement may be as described for FIGS. 9B to 9D.

FIG. 1 shows a vessel 10 with two foils 18, one of which is hydrofoil system in accordance with the present invention and the other is a foil without the propulsion system of the present invention. It is to be appreciated that a vessel will comprise a minimum of two foils (one towards the front and one towards the rear of the vessel), one or both of which may include the propulsion features of the present invention. Where multiple foils 18 are provided, the actuators 22 for each flap 20 of each foil 18 are independently controlled by a single controller 12.

A vessel could be equipped with one hydrofoil system in accordance with the present invention and one non-propulsion foil unit. However, if the weight of the vessel requires more thrust to move around then the vessel could be equipped with two foils provided with propulsion.

The hydrofoil system of the present invention therefore allows human-free flight control. As each foil 18 is always tuned and set for optimum performance i.e. low drag, significantly reduced drag through the water is ensured. This provides the technical advantage of either a greater autonomy range or an increase cruise speed for a given battery capacity.

The engine cooling used by the hydrofoil system of the present invention, whether water-flow cooling or heat-transfer cooling, negates the requirement for a separate mechanical cooling system, thereby reducing the complexity and weight of the system, which contributes to efficiency and increasing battery life.

It is to be appreciated that the hydrofoil system of the present invention may be provided as an integral part of a newly built vessel 10 or may be retrofitted to existing vessels 10 to achieve optimal performance.

Finally, use of the hydrofoil system of the present invention provides optimal performance with increase ride comfort for passengers as less of the hull 14 of vessel 10 is exposed to the surrounding water conditions, thereby ensuring a smoother ride.

The invention claimed is:

1. A waterborne vessel including a hydrofoil system, the hydrofoil system comprising a controller;

a foil for engagement with the waterborne vessel, the foil comprising a plurality of adjustment members operable to vary the lift characteristics of the waterborne vessel;

a propeller;

an engine and gearbox located adjacent the foil and operable/in mechanical communication with the propeller; and a plurality of sensors in electrical communication with the controller, each sensor configured to monitor flight parameters of the waterborne vessel and generate measured flight parameter data, wherein the controller is in communication with the adjustment members, the engine and the sensors and wherein the controller is configured to receive measured flight parameter data from the sensors and to control the operation of the engine and the position of the adjustment members in dependence upon the received measured flight parameter data.

2. A hydrofoil system as claimed in claim 1, further comprising a battery system in electrical communication with the controller and the engine and operable by the controller to provide power to the engine.

3. A hydrofoil system as claimed in claim 1, wherein each of the adjustment members is operable to vary one or more of pitch, roll, heave and yaw of the waterborne vessel.

4. A hydrofoil system as claimed in claim 1, wherein each adjustment member comprises a flap and an actuator, wherein the flap is moveable relative to the foil on activation of the actuator by the controller.

5. A hydrofoil system as claimed in claim 4, wherein the actuators are integrated within the foil.

6. A hydrofoil system as claimed in claim 4, wherein each of the plurality of flaps is independently adjustable.

7. A hydrofoil system as claimed in claim 4 wherein the plurality of flaps comprises at least one set of two aligned flaps.

8. A hydrofoil system as claimed in claim 1, wherein the foil comprises a water-tight casing, and wherein the engine and gearbox are arranged within the water-tight casing.

9. A hydrofoil system as claimed in claim 8, wherein the engine and gearbox are in thermal contact with the water-tight casing.

10. A hydrofoil system as claimed in claim 8, wherein the propeller is located adjacent the gearbox, distal to the engine.

11. A hydrofoil system as claimed in claim 1, wherein the measured flight parameter data comprises one or more selected from the group comprising acceleration data, vessel position data (pitch, heave, yaw, roll), actuator positional data, external environmental factors, and the environment the vessel is moving in.

12. A hydrofoil system as claimed in claim 1, wherein the controller is located within the hull of the waterborne vessel and the foil is located beneath the floating waterline on the hull exterior of the waterborne vessel.

13. A hydrofoil system as claimed in claim 4, further comprising a battery system in electrical communication with the foil and operable to provide power to the engine.

14. A hydrofoil system as claimed in claim 13, wherein the battery system further provides power to the actuator.

* * * * *